US006537615B2

(12) United States Patent
Gilfert et al.

(10) Patent No.: US 6,537,615 B2
(45) **Date of Patent: *Mar. 25, 2003**

(54) STEAM-ASSISTED PAPER IMPREGNATION

(75) Inventors: Charles John Gilfert, Cincinnati, OH (US); Dimitris Ioannis Collias, Mason, OH (US); Steven Michael Schennum, West Chester, OH (US)

(73) Assignee: Paper Technology Foundation Inc., Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/190,517

(22) Filed: Nov. 12, 1998

(65) Prior Publication Data

US 2001/0041222 A1 Nov. 15, 2001

(51) Int. Cl.[7] ..... B05D 3/00

(52) U.S. Cl. ..... 427/335; 427/366; 427/370; 427/377; 427/382; 427/391; 427/361

(58) Field of Search ..... 427/366, 370, 427/377, 382, 289, 335, 391, 384

(56) References Cited

U.S. PATENT DOCUMENTS

| | | | | |
|---|---|---|---|---|
| 2,877,498 A | * | 3/1959 | Schneider | 162/169 |
| 2,926,116 A | | 2/1960 | Keim | 162/164 |
| 3,332,901 A | | 7/1967 | Keim | 260/29.2 |

(List continued on next page.)

FOREIGN PATENT DOCUMENTS

| | | |
|---|---|---|
| EP | 0418015 A1 | 3/1991 |
| EP | 0816562 A2 | 1/199 |
| WO | WO 98/24974 | 6/1998 8 |

OTHER PUBLICATIONS

Siegfried Fischer: "Pressure Impregnating of Decorative and Kraft Papers"; 1994; Plastic Laminates Symposium, p. 133–137.

William O. Kroeschell: "Bonding on the corrugator"; 1989; TAPPI, p. 67–72.

R. Nigel Jopson: "Saturation technology for corrugated containers"; Apr. 1993; Tappi Journal vol. 76, No. 4, p. 207–214.

Robert W. Hagemeyer et al.: "Pulp and Paper Manufacture, 3rd edition, vol. 6"; 1992; The Joint Textbook Committee of the Paper Industry, Tappi, CPPA, Montreal, Canada, p. 65–85 (H. H. Espy: "Wet–strength resins").

Database WPI–Section Ch, Week 199347: Derwent Publications Ltd., London, GB; Class A23, AN 1993–375856 XP 002128022 & SU 1 773 925A (Below Chem Articles Prodn Assoc), Nov. 7, 1992, abstract.

Database WPI–Section Ch, Week 197548: Derwent Publications Ltd., London, GB; Class A28, AN 1975–79396W XP 002128024 & JP 50 076308A (Sumitomo Chem Co Ltd), Jun. 23, 1975, abstract.

Database WPI–Section Ch, Week 199124: Derwent Publications Ltd., London, GB; Class A82, AN 1991–176285 XP 002128023 & SU 1 581 465A (Mariupol Mettallurgy), Jul. 30, 1990, abstract.

*Primary Examiner*—Shrive P. Beck
*Assistant Examiner*—Kirsten Crockford Jolley

(57) ABSTRACT

The present invention relates to a process of using steam to achieve simultaneous impregnation and drying of lignocellulosic material to improve the strength of lignocellulosic material and to reduce the number of serial processing steps. The steam may be either indigenously generated by way of a heated press or heated nip, or the steam may be externally applied.

23 Claims, 3 Drawing Sheets

U.S. PATENT DOCUMENTS 3,656,991 A * 4/1972 Blackwell et al. ..... 427/160
3,849,184 A 11/1974 Roberts ..... 117/155
3,888,624 A * 6/1975 Blackwell et al. ..... 8/21 C
3,982,993 A 9/1976 Fife ..... 162/158
4,040,899 A * 8/1977 Emerson ..... 162/13
4,191,610 A 3/1980 Prior ..... 162/147
4,240,935 A 12/1980 Dumas ..... 260/9
4,242,808 A * 1/1981 Luthi ..... 162/207
4,520,048 A * 5/1985 Ranger ..... 427/366
4,551,199 A * 11/1985 Weldon ..... 162/109
4,588,616 A 5/1986 Menser ..... 427/430.1
4,702,943 A 10/1987 Long ..... 427/282
4,718,981 A * 1/1988 Swenson et al. ..... 162/142
4,718,982 A * 1/1988 Swenson et al. ..... 162/206
4,740,391 A 4/1988 Long ..... 427/286
4,826,555 A 5/1989 Long ..... 156/324
4,894,118 A * 1/1990 Edwards et al. ..... 162/112
4,915,989 A 4/1990 Menser et al. ..... 427/434.2
4,919,758 A * 4/1990 Wagle et al. ..... 162/175
4,936,920 A * 6/1990 Keritsis et al. ..... 131/77
4,982,686 A 1/1991 Long ..... 118/406
5,097,764 A * 3/1992 Waizmann ..... 101/425
5,120,773 A 6/1992 Fischer et al. ..... 523/400
5,210,958 A * 5/1993 Bond et al. ..... 34/18
5,239,047 A 8/1993 Devore et al. ..... 528/339.3
5,242,545 A 9/1993 Bradway et al. ..... 162/135
5,338,404 A 8/1994 Lucas et al. ..... 162/163
5,378,497 A * 1/1995 Johnson et al. ..... 427/364
5,404,654 A 4/1995 Babinsky et al. ..... 34/122
5,456,800 A 10/1995 Tansley et al. ..... 162/158
5,510,004 A 4/1996 Allen ..... 162/168.2
5,576,546 A 11/1996 Gagnon ..... 250/369
5,585,456 A 12/1996 Dulaney et al. ..... 528/332
5,630,285 A * 5/1997 Kerttula et al. ..... 34/446
5,698,295 A 12/1997 Benner et al. ..... 428/182
5,772,182 A 6/1998 Stambaugh, Sr. et al. .. 251/325
5,776,546 A * 7/1998 Long ..... 427/402
5,935,383 A * 8/1999 Sun et al. ..... 162/158

* cited by examiner

STEAM-ASSISTED PAPER IMPREGNATION

FIELD OF THE INVENTION

The present invention relates to a process of using steam to assist achieving impregnation of lignocellulosic materials with various additives. The processing conditions are such that, in addition to impregnation, this process simultaneously achieves drying of the lignocellulosic materials.

BACKGROUND OF THE INVENTION

The properties of lignocellulosic materials, such as paper, linerboard, corrugated and cardboard, can be improved to varying degrees by incorporating various additives to the materials. For example, it has been shown that the strength of linerboard in compression or tension can be substantially increased by incorporating sodium silicate or starch inside it. Usually the additives are in the form of a solution or a dispersion, and for the purposes of this disclosure, solution and dispersion may be used interchangeably. Similarly, for the purpose of this disclosure the terms agent, active, additive and saturant are used interchangeably. Finally, the terms incorporation, treatment, impregnation and saturation are used interchangeably for the purposes of this disclosure.

In general, this incorporation can be achieved using various methods, such as (but not limited to): 1) immersion of the lignocellulosic materials into a bath solution or dispersion of the additives, 2) spraying or brushing a solution or dispersion of the additives onto the lignocellulosic materials, and 3) coating (e.g. roll, blade, gravure, etc.) of the lignocellulosic materials with a solution or dispersion of the additives. However, the above methods do not achieve sufficient incorporation of the additives inside the lignocellulosic materials. In most cases, this results in minimal property improvements.

One treatment method that solves the problem of insufficient incorporation of additives is described in U.S. Pat. No. 5,776,546, issued to Long, and assigned to MiPly Equipment Inc. The MiPly process uses one or two converging pressure chambers (e.g. in the form of a journal bearing) to achieve paper web impregnation with various additives. However, when the solvent (or its major part) of the additive solution or dispersion is water then there is typically a need for drying after the MiPly process. However, U.S. Pat. No. 5,776,546 does not disclose nor teach the simultaneous drying of lignocellulosic materials. This drying can be achieved in various processing equipment in series with the MiPly process, such as cylinder dryers, air flotation dryers, impulse dryer, Condebelt dryer, superheated steam dryer, etc.

The Condebelt drying process is described in U.S. Pat. No. 5,722,182, invented by Lehtinen, and assigned to Valmet Inc. In the Condebelt process the paper web is carried on a band formed of two permeable wires (in the form of a fine and a coarse screen) and fed between two smooth steel bands. The upper band is kept hot by contact with saturated steam and is used to apply pressure in the z direction (i.e., press drying) of the paper web. Typical pressure values are between 2 bars and 5 bars (between 29 psi and 72.5 psi), while the maximum pressure is 10 bars (145 psi). The temperature values of the upper band are between 130° C. and 160° C. (between 266° F. and 320° F.), while the maximum temperature is 180° C. (356° F.). The lower band is water-cooled and kept at lower temperature, typically less than 90° C. (194° F.). According to Valmet's publications, the z-directional pressure and the accompanied elevated temperature of the upper band have been found to: 1) plasticize the fibers, 2) cause flattening of the fiber-to-fiber bonds, 3) cause softening of the fiber surface material (i.e., lignin and hemicelluloses) and flowing to form crescent-shaped comer weld bridges between two fibers, and 4) increase the paper web density. All the above effects result in improvements in the dry and wet strength properties as well as other properties. A typical increase in the strength of linerboard dried with the Condebelt process has been reported to be up to 30%. However, U.S. Pat. No. 5,772,182 does not disclose or teach the adding and impregnating of additives into lignocellulosic materials during the drying process.

Another drying process uses superheated steam supplied from an external source to evaporate the water inside the paper web. U.S. Pat. No. 5,210,958 issued to Bond et al., and assigned to McGill University and the Pulp & Paper Research Institute of Canada describes the use of impinging superheated steam (i.e., exogenous steam) to dry paper webs. However, U.S. Pat. No. 5,210,958 does not disclose or teach the adding and impregnating of additives into lignocellulosic materials during the drying process.

What has been missing is a process that uses steam to assist in achieving impregnation of lignocellulosic materials with various additives while providing simultaneous drying of the lignocellulosic materials.

SUMMARY OF THE INVENTION

The present invention relates to a process that uses steam to assist achieving impregnation of lignocellulosic materials with various additives. This steam-assisted process can achieve simultaneous drying of the lignocellulosic materials. Therefore, the properties of the lignocellulosic materials are improved and the number of serial processing steps is reduced.

DETAILED DESCRIPTION OF THE INVENTION

One way to improve the properties of lignocellulosic materials (for example, paper, linerboard, corrugating medium, carton board, and paper structures in general) is to incorporate one or more additives (also called agents) inside their matrices or fiber webs. Strength is an example of a typical important paper property that can be increased by incorporating additives (i.e., strengthening agents), such as lignosulfonate, other lignin derivatives, sodium silicate, starch, xylan, polyvinyl acetate, acrylic polymers, etc., into the paper matrix. Lignin derivatives include, but are not limited to, kraft lignin, organosolv lignin, chemically modified lignin derivatives, and mixtures thereof. In general and before application, the additives can be in the form of a solution or dispersion, with the solvent being either 100% water or a mixed system of water and organic solvents. However, the commonly known processes of incorporating said strengthening agents into lignocellulosic materials either do not achieve sufficient penetration of the agents into the materials and/or require multiple processing steps to incorporate the agents into the materials and then to remove the solvents (i.e., dry) from the materials.

The process of the present invention uses steam to assist carrying and incorporating the additives inside the paper matrix (i.e., impregnate or saturate the matrix with the additives). The steam can be either: 1) generated from the water that is the solvent or part of the solvent of the additives solution or dispersion (so-called indigenous steam), or 2) supplied by an outside source (so-called exogenous steam). In the former case, the indigenous steam can be generated by contact with heated surfaces (e.g. platens, belts, rolls etc.) or hot gases (e.g. hot air from a hot air gun). In the latter case, the exogenous steam can be saturated or superheated. Note that a combination of indigenous and exogenous steam can also be used. At the same time, and in either case, the steam itself and/or the heat that is carried by the steam assists in drying the paper matrix. Drying is defined as a process in which a material's post-process moisture content level is lower than its pre-process moisture content level.

Figure 1:
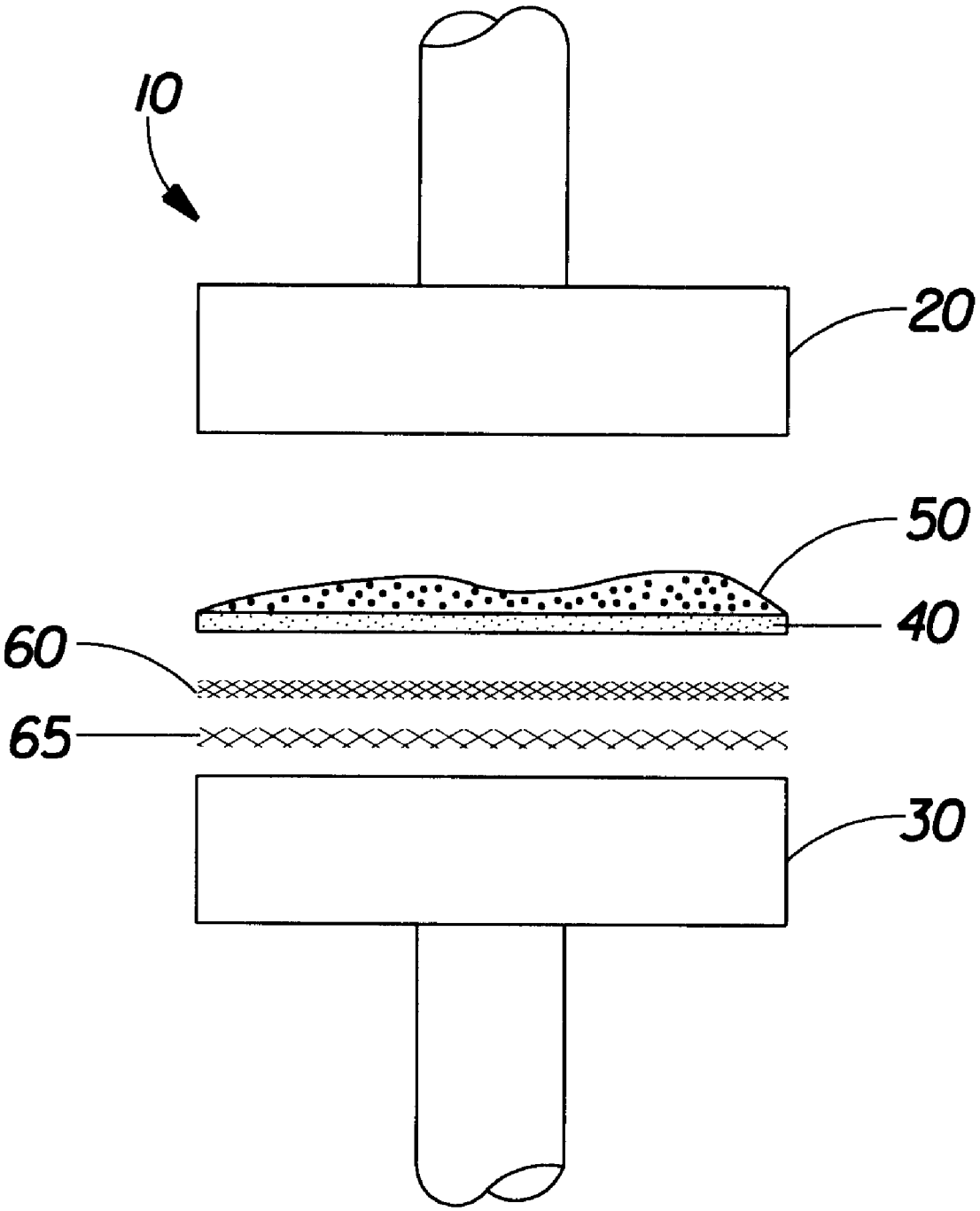
FIG. 1 shows a batch process that utilizes a heated press to generate indigenous steam. This steam assists in achieving impregnation of the lignocellulosic material web with various additives.

FIG. 1 refers to the use of indigenous steam in a batch equipment utilizing a heated press 10. Heated press 10 has a top platen 20 and a bottom platen 30. The operating temperature range for top platen 20 is from about 200° F. (93° C.) to about 850° F. (454° C.), more preferably from about 300° F. (149° C.) to about 500° F. (260° C.), and most preferably about 400° F. (204° C.). The operating temperature for bottom platen 30 is from about 70° F. (21° C.) to about 300° F. (149° C.), most preferably about 200° F. (93° C.). It is important to have top platen 20 set at a higher operating temperature than bottom platen 30, so that the steam generated will travel towards bottom platen 30 through the lignocellulosic material 40.

Prior to applying heat from heated press 10 to lignocellulosic material 40, lignocellulosic material 40 must be wet, i.e., with moisture content range from about 5% to about 80%, and most preferably from about 20% to 60%. As an example, wet paper coming out of the wet end of the papermaking process can be used. Another possible method to wet lignocellulosic material 40 is to soak lignocellulosic material 40 into a bath of water or shower the paper with steam. Yet another possible methods to wet lignocellulosic material 40 include, but are not limited to, spraying or pouring water onto lignocellulosic material 40.

After lignocellulosic material 40 is wetted, additive solution 50 is applied to the top surface of lignocellulosic material 40 by gravity-feed dispensers (not shown). Lignosulfonate and sodium silicate are two strengthening agents used; however, a wide variety of other useable strengthening agents exists such as, but not limited to, other lignin derivatives, starch, xylan, polyvinyl acetate, and acrylic polymers. Additive solution 50 may be applied to lignocellulosic material 40 by various other methods such as, but not limited to, spraying, brushing, roll coating, blade coating, gravure coating, etc. Various forms of additive solution 50 may be used such as, but not limited to, liquid, aqueous solution or dispersion, or solution or dispersion in mixed solvents (e.g. water and organic solvents). Instead of the additive being in solution 75, the additive may also be in the form of a powder.

A set of two screens 60 and 65 are placed onto bottom platen 30 of heated press 10. The top screen 60 is fine and the bottom screen 65 is coarse. The top screen 60 has a mesh size (i.e., number of openings per linear inch) ranging from about 50 to about 200, most preferably about 100, and the bottom screen 65 has a mesh size ranging from about 10 to about 50, most preferably about 20. The screens can be square (i.e., have the same mesh size in either x or y direction), or non square. Furthermore, the screens may be plastic, metallic, etc., and can be made from interwoven wires or perforated plates or any other form. Treated lignocellulosic material 40 is placed on top of the screens 60 and 65 with the treated side up. Screens 60 and 65 are placed under the treated material so that steam and air may vent and water may collect during processing after penetrating lignocellulosic material 40 from the top side. Fine screen 60 was added on top of course screen 65, in order to improve surface appearance of lignocellulosic material 40. If surface appearance is not important then there is no need for fine screen 60, and coarse screen 65 will be sufficient for venting and collection. Other methods of venting and collecting the system "air/steam/water" are, but not limited to, porous platen, porous metal platen, porous plastic platen, gravure surface platen, and roughened surface platen.

Once lignocellulosic material 40 and screens 60 and 65 are in place, heated top platen 20 is engaged and pressed against treated lignocellulosic material 40 at a pressure from about 30 psi (2 bars) to about 1,000 psi (69 bars), preferably from about 100 psi (6.9 bars) to about 400 psi (27.6 bars), and most preferably about 300 psi (20.7 bars). The heat from top platen 20 causes the water from additive solution 50 to boil thus generating indigenous steam. Note, that when the additive is in powder form, the indigenous steam is generated from the moisture contained within the lignocellulosic material 40. The indigenous steam travels through lignocellulosic material 40 while assisting in carrying additive solution 50 towards screens 60 and 65. As a result, additive solution 50 is eventually deposited throughout the thickness of lignocellulosic material 40. Also as a result of the steam, lignocellulosic material 40 is simultaneously dried. After a dwell time (defined as the time during which the platens are engaged causing pressure and/or heat to be transferred to lignocellulosic material 40) ranging from about 1 millisecond to about 20 seconds, most preferably 10 seconds, top platen 20 is disengaged and treated lignocellulosic material 40 is removed.

Figure 2:
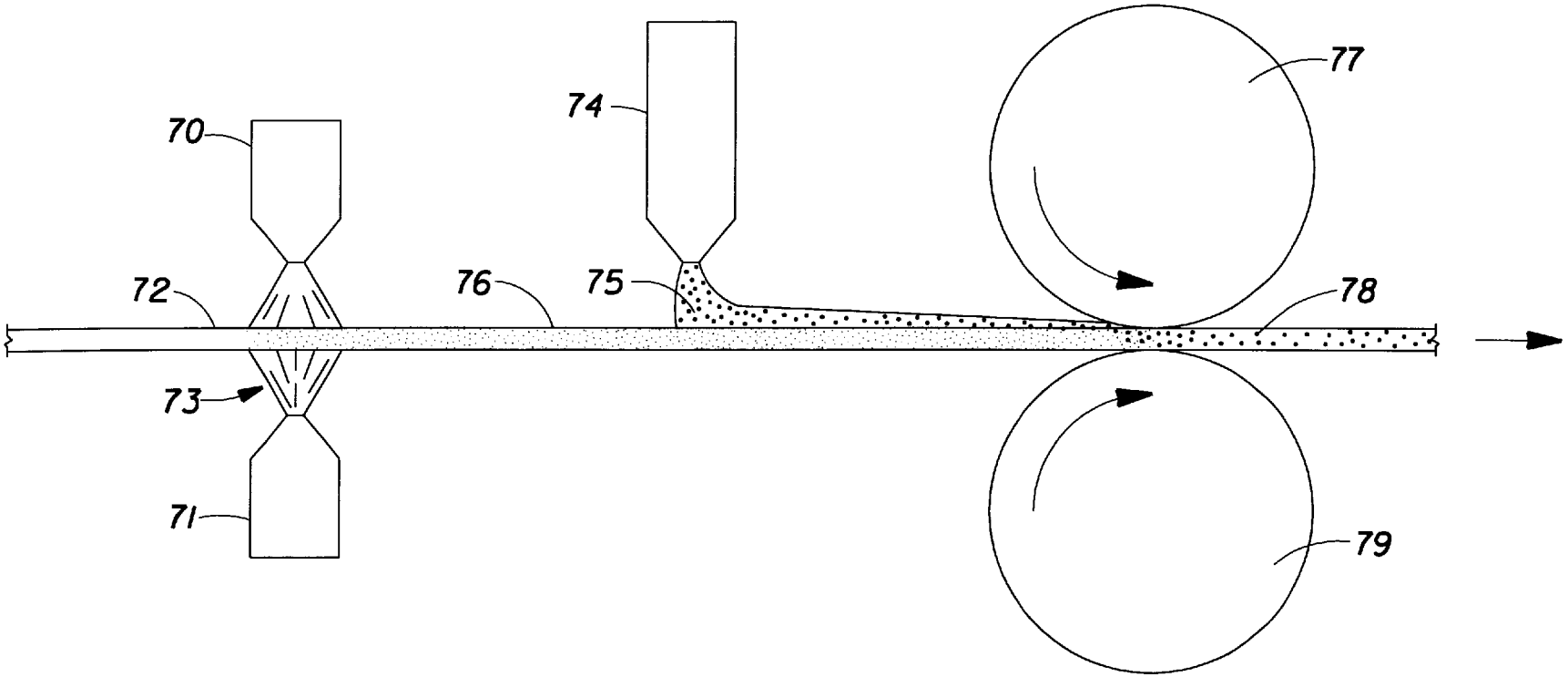
FIG. 2 shows an alternative continuous process that uses a set of heated surfaces to generate indigenous steam. This steam assists in achieving impregnation of the lignocellulosic material web with various additives.

Another possible method to practice the present invention using indigenous steam utilizes continuous processing equipment nips. Nip is defined as two surfaces moving in proximity of each other. Typical examples of nips are, but not limited to, rotary (i.e., between two undeformable rolls), extended (i.e., between one undeformable roll and one deformable surface; [e.g.: shoe press]; or between two deformable rolls), or belt (i.e., between two belts, either metallic or plastic; or between a belt and a roll). Now referring to FIG. 2, an alternative continuous process is shown. The continuous process incorporates a top heated pressure surface 77 and a bottom heated pressure surface 79 that would operate essentially the same and with similar process settings as the aforementioned top platen 20 and bottom platen 30 of batch process 10. Pressure within the heated nip, drives the additives from additive solution 75 into the moving lignocellulosic material web 72. In this continuous process lignocellulosic material 72 is initially treated with water 73 using a top sprayer 70 and a bottom sprayer 71. Other possible methods for wetting the paper include, but are not limited to, pouring or spraying water from a single side and soaking lignocellulosic material 72 in a bath of water. After lignocellulosic material 72 is wetted with similar moisture contents as previously mentioned for the batch process, additive solution 75 can be applied to the top surface of the wet lignocellulosic material 76 by a gravity feed dispenser 74. Various other methods for dispensing additive solution 75 include, but not limited to, spraying, brushing, roll coating, blade coating, gravure coating, etc.

Similar to the batch process previously mentioned, top heated pressure surface 77 is at a higher operating temperature than bottom heated pressure surface 79, so that the steam generated will travel toward the bottom surface 79 through lignocellulosic material 72. The indigenous steam generated during this continuous process propagates through the thickness of lignocellulosic material 72 and similar to the batch process assists in carrying additive from additive solution 75 toward bottom heated pressure surface 79, distributing additive from additive solution 75 throughout lignocellulosic material 78 and simultaneously drying the lignocellulosic material. This propagation of additive from additive solution 75 and indigenous steam is preferably facilitated by venting and collecting the system "air/steam/water" at the lower heated pressure surface 79. Methods of venting and collecting the system "air/steam/water" include, but are not limited to, porous nip, porous metal nip, porous plastic nip, gravure surface nip, and roughened surface nip. Temperatures of the top and bottom surfaces, velocity of the surfaces, amount of solution initially deposited on the lignocellulosic material web, nip pressure, and moisture content of the lignocellulosic material are some of the parameters that control the incorporation of the additives into the lignocellulosic materials. Similarly to the batch process of FIG. 1, the additive may also be in powder form rather than in solution form.

Figure 3:
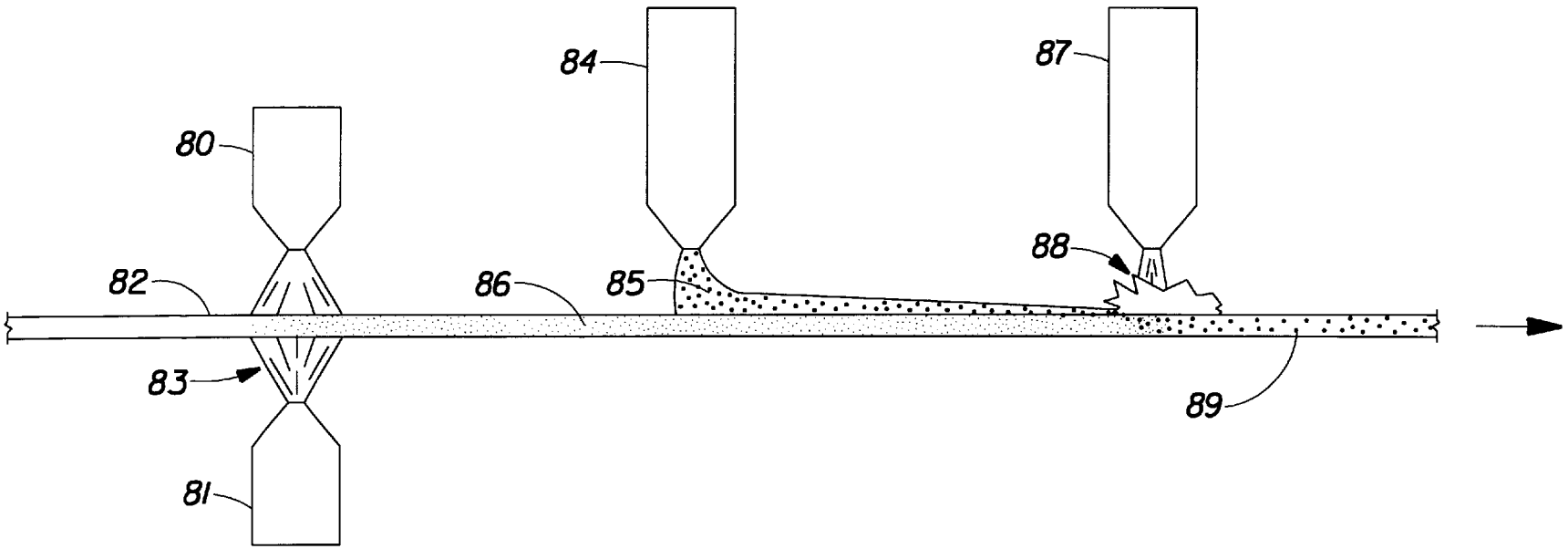
FIG. 3 shows an alternative continuous process that utilizes exogenous steam to impregnate various additives inside the lignocellulosic material web.

The use of exogenous steam in a continuous process is shown in FIG. 3. The exogenous steam is used to both drive the additive from additive solution 75 into the lignocellulosic material web 82 and dry the treated web. Similar to the batch and continuous processes using indigenous steam (steam generated from the existing water in the treatment and lignocellulosic material), the exogenous continuous method pre-treats the lignocellulosic material 82 with water 83, using an application means, preferably, but not limited to, a top sprayer 80 and a bottom sprayer 81. Additive solution 85 is then applied to the wet lignocellulosic material web 86 using an application means, preferably, but not limited to, a gravity feed applicator 84. A source of exogenous (external) steam 87 applies a jet of steam 88, preferably superheated "dry" steam, to the moving "wet" lignocellulosic material 86. The exogenous steam 88 assists in driving the additive from additive solution 85 through the thickness of the lignocellulosic material web 82 and drying the lignocellulosic material web 82. As a result, the properties of the treated lignocellulosic material 89 are altered (e.g. strengthened if the treatment contains a strengthening agent) and the number of serial processing steps (drying) is reduced. Finally, in yet another alternative of the continuous process, steam 88 is substituted with hot air. Similarly to the continuous process of FIG. 2, the additive may also be in powder form rather than in solution form.

Mixtures of additives can also be used to provide specific property enhancements to the lignocellulosic materials. These mixtures can be applied to the materials either at the same time as a mixture or sequentially as two or more different dispersions or solutions.

EXAMPLE 1

Batch experiments are conducted in a heated press similar to FIG. 1 and involve the following steps: (1) a 35# linerboard (35 pounds per thousand square feet; 35 lb/msf; 170 g/m$^2$ or 170 grams per square meter; product USP70 linerboard from Georgia-Pacific Inc. (Atlanta, Ga.); 5"×7" in size; 3.86 g in weight) is wetted to about 26% total moisture content (1.38 g of water); (2) a calcium lignosulfonate aqueous solution (LIGNOSITE 50 from Georgia-Pacific Inc.; 40% lignosulfonate solids and 10% inert solids; 6.83 g in weight) is deposited by brushing onto the top side of the linerboard; (3) the top surface of the linerboard is covered by teflon film and the bottom surface is supported by two screens (one fine and one coarse) and a film; and (4) the linerboard assembly is placed in the heated press with the upper platen set at 400° F. and the lower platen set at 200° F., and pressurized to 10,000 lbf (285 psi, 19.5 bars, 1.95 MPa). The dwell time is 10 s.

The treated 35# linerboard comes out of the press dry and with 25% calcium lignosulfonate add-on. Furthermore, the samples are fully penetrated by calcium lignosulfonate as this is judged by the appearance of calcium lignosulfonate on the opposite side of its initial deposition and by energy-dispersive X-ray analysis (EDAX) tests. After preconditioning and conditioning, both treated and untreated 35# linerboard samples are subjected to ring crush tests (RCT; TAPPI standard T822-om93) at both at 50% and 80% relative humidity (RH), and in the machine (MD) and cross (CD) directions. The untreated 35# linerboard samples exhibit the following RCT values in lbf/6 in.: 50% RH CD: 52.1±3.8; 50% RH MD: 73.1±7.4; 80% RH CD: 40.7±2.2; and 80% RH MD: 58.7±4.5. The treated 35# linerboard samples exhibit the following RCT values in lbf/6 in.: 50% RH CD: 144±13; 50% RH MD: 159±16; 80% RH CD: 80±8; and 80% RH MD: 95±11. These results show that the steam-assisted impregnation method achieves about 175% strength increase with only 25% add-on at 50% RH and in the CD, i.e., the ratio of % strength increase to % add-on is 7.1.

Lignocellulosic materials having a basis weight ranging from about 80 grams per square meter to about 350 grams per square meter should also perform successfully within a similar process.

EXAMPLE 2

In another set of experiments, the same conditions as in Example 1 are used but with initial deposition of only 3.42 g of LIGNOSITE 50. The level of add-on achieved is 12.5%. The treated 35# linerboard samples exhibit a CD RCT value of 121±21 lbf/6 in. at 50% RH. This result shows that the steam-assisted impregnation method achieves about 130% strength increase with only 12.5%, i.e., the ratio of % strength increase to % add-on is 10.6.

EXAMPLE 3

The experimental setup, linerboard samples, and conditions of Example 1 are used with sodium silicate as the additive. The sodium silicate solution is supplied from the PQ corporation (Valley Forge, Pa.) and used as received (i.e., grade N® with 8.9% $Na_2O$ and 28.7% $SiO_2$–37.6% total solids). The amount of sodium silicate solution deposited on top of the 35# linerboard before the experiment is 4.3 g. The level of add-on achieved is 24%. The saturated 35# linerboard samples exhibit the following RCT values in lbf/6 in.: 50% RH CD: 120.1±6.9; 50% RH MD: 152.1±13.3; 80% RH CD: 94.1±14.0; and 80% RH MD: 112.0±8.7. These results show that the steam-assisted impregnation method achieves about 130% strength increase with only 24% add-on at 50% RH and in the CD, i.e., the ratio of % strength increase to % add-on is 5.4.

We claim:

1. A process of using exogenous steam to achieve simultaneous impregnation and drying of lignocellulosic material, comprising the steps of:

a) treating a lignocellulosic material with an additive by applying said additive onto a top surface of said material; and b) impinging a jet of steam on said top surface of said treated lignocellulosic material to impregnate said additive from said top surface toward an opposite bottom surface of said material and to dry said material.

2. A process according to claim 1, wherein said lignocellulosic material is paper having a basis weight ranging from about 80 grams per square meter to about 350 grams per square meter.

3. A process according to claim 1, wherein said additive is a strengthening agent.

4. A process according to claim 3, wherein said strengthening agent is selected from the group consisting of lignosulfonate, kraft lignin, organosolv lignin, chemically modified lignosulfonate, chemically modified kraft lignin, chemically modified organosolv lignin, sodium silicate, starch, xylan, polyvinyl acetate, acrylic polymers, and mixtures thereof.

5. A process according to claim 1, wherein said steam is superheated steam.

6. A process of using indigenous steam to achieve simultaneous impregnation and drying of lignocellulosic material, comprising the steps of:

a) treating a lignocellulosic material with an additive by applying said additive onto a top surface of said material, said treated lignocellulosic material containing moisture;

b) placing said treated lignocellulosic material into a heated press with said top surface proximate a top press platen and an opposite bottom surface proximate a bottom press platen providing venting means;

c) applying heat and pressure from said heated press with said top press platen at a higher temperature than said bottom press platen to impregnate said additive from said top surface toward said bottom surface of said material and to dry said material; and d) removing said treated lignocellulosic material from said heated press.

7. A process according to claim 6, wherein said additive is a strengthening agent.

8. A process according to claim 7, wherein said strengthening agent is selected from the group consisting of lignosulfonate, kraft lignin, organosolv lignin, chemically modified lignosulfonate, chemically modified kraft lignin, chemically modified organosolv lignin, sodium silicate, starch, xylan, polyvinyl acetate, acrylic polymers, and mixtures thereof.

9. A process according to claim 6, wherein steam is indigenously generated from said moisture being heated by said heated press.

10. A process according to claim 6, wherein said moisture has a content range within said lignocellulosic material from about 5% to 80% by weight prior to placing said treated lignocellulosic material into said heated press.

11. A process according to claim 6, wherein said venting means is selected from the group consisting of a perforated screen, porous platen, porous metal platen, porous plastic platen, gravure surface platen, roughened surface platen, and mixtures thereof.

12. A process according to claim 11, wherein said perforated screen comprises of a top perforated screen and a bottom perforated screen, wherein said top perforated screen has a mesh size ranging from about 50 to about 200 and said bottom perforated screen has a mesh size ranging from about 10 to about 50.

13. A process according to claim 6, wherein a dwell time for said step of applying heat and pressure from said heated press while providing venting means ranges from about 1 millisecond to about 20 seconds.

14. A process according to claim 6, wherein said top press platen has a temperature range from about 93 degrees C. to about 454 degrees C. and said bottom press platen has a temperature range from about 21 degrees C. to about 149 degrees C.

15. A process of using indigenous steam to achieve simultaneous impregnation and drying of lignocellulosic material, comprising the steps of:

a) treating a lignocellulosic material with an additive by applying said additive onto a top surface of said material, said treated lignocellulosic material containing moisture;

b) introducing said treated lignocellulosic material into a heated nip with said top surface proximate a top nip-forming surface and an opposite bottom surface proximate a bottom nip-forming surface providing venting means;

c) applying heat and pressure from said heated nip with said top nip-forming surface at a higher temperature than said bottom nip-forming surface to impregnate said additive from said top surface toward said bottom surface of said material and to dry said material; and d) removing said treated lignocellulosic material from said heated nip.

16. A process according to claim 15, wherein said additive is a strengthening agent.

17. A process according to claim 16, wherein said strengthening agent is selected from the group consisting of lignosulfonate, kraft lignin, organosolv lignin, chemically modified lignosulfonate, chemically modified kraft lignin, chemically modified organosolv lignin, sodium silicate, starch, xylan, polyvinyl acetate, acrylic polymers, and mixtures thereof.

18. A process according to claim 15, wherein steam is indigenously generated from said moisture being heated by said heated nip.

19. A process according to claim 15, wherein said moisture has a content range within said lignocellulosic material from about 5% to 80% by weight prior to placing said treated lignocellulosic material into said heated nip.

20. A process according to claim 15, wherein said venting means is selected from the group consisting of perforated screen, porous nip, porous metal nip, porous plastic nip, gravure surface nip, and roughened surface nip.

21. A process according to claim 20, wherein said perforated screen comprises of a top perforated screen and a bottom perforated screen, wherein said top perforated screen has a mesh size ranging from about 50 to about 200 and said bottom perforated screen has a mesh size ranging from about 10 to about 50.

22. A process according to claim 15, wherein a dwell time for said step of applying heat and pressure from said heated nip while providing venting means ranges from about 1 millisecond to about 20 seconds.

23. A process according to claim 15, wherein said top nip-forming surface has a temperature range from about 93 degrees C. to about 454 degrees C. and said bottom nip-forming surface has a temperature range from about 21 degrees C. to about 149 degrees C.

* * * * *